US007677504B2

(12) United States Patent
Hutchinson et al.

(10) Patent No.: US 7,677,504 B2
(45) Date of Patent: Mar. 16, 2010

(54) GUTTER COVER CLIP

(75) Inventors: Patrick William Hutchinson, Wauwatosa, WI (US); Mel Freitag, Waukesha, WI (US); Timothy G. Staub, Midlothian, VA (US)

(73) Assignee: R & B Wagner, Inc., Butler, WI (US)

( * ) Notice: Subject to any disclaimer, the term of this patent is extended or adjusted under 35 U.S.C. 154(b) by 512 days.

(21) Appl. No.: 11/462,275

(22) Filed: Aug. 3, 2006

(65) Prior Publication Data

US 2008/0028687 A1 Feb. 7, 2008

(51) Int. Cl.
*E04D 13/068* (2006.01)

(52) U.S. Cl. ..... 248/48.2; 52/712; 52/11; 52/12

(58) Field of Classification Search ..... 52/11, 52/12, 13, 14, 15, 16, 712; 248/48.1, 48.2, 248/37.3, 37.6, 316.7; 24/295
See application file for complete search history.

(56) References Cited

U.S. PATENT DOCUMENTS

| | | | | | |
|---|---|---|---|---|---|
| 2,672,832 | A | | 3/1954 | Goetz | |
| 2,997,763 | A | * | 8/1961 | Serfass | 24/531 |
| 3,351,206 | A | * | 11/1967 | Wennerstrom | 210/474 |
| 3,420,378 | A | * | 1/1969 | Turner | 210/474 |
| 4,036,761 | A | * | 7/1977 | Rankin | 210/474 |
| 4,404,775 | A | | 9/1983 | Demartini | |
| 4,435,925 | A | | 3/1984 | Jefferys | |
| 4,745,657 | A | * | 5/1988 | Faye | 16/226 |
| 4,750,300 | A | * | 6/1988 | Winger, Jr. | 52/12 |
| 4,796,390 | A | | 1/1989 | Demartini | |
| 5,016,404 | A | | 5/1991 | Briggs | |
| 5,056,276 | A | * | 10/1991 | Nielsen et al. | 52/12 |
| 5,216,851 | A | | 6/1993 | Kuhns | |
| 5,457,916 | A | | 10/1995 | Tenute | |
| 5,819,476 | A | * | 10/1998 | Annestedt, Sr. | 52/11 |
| 6,269,592 | B1 | * | 8/2001 | Rutter | 52/12 |
| 6,735,907 | B2 | * | 5/2004 | Stevens | 52/12 |
| 2002/0069594 | A1 | * | 6/2002 | Sweet | 52/12 |
| 2004/0000098 | A1 | * | 1/2004 | Knudson | 52/12 |
| 2004/0250478 | A1 | * | 12/2004 | McDonald et al. | 52/11 |
| 2005/0011136 | A1 | * | 1/2005 | Filippi | 52/11 |
| 2005/0108951 | A1 | * | 5/2005 | McDonald et al. | 52/11 |
| 2005/0193639 | A1 | * | 9/2005 | Knudson et al. | 52/12 |
| 2005/0274081 | A1 | * | 12/2005 | Welty | 52/120 |

FOREIGN PATENT DOCUMENTS

| | | | | |
|---|---|---|---|---|
| CA | 2267738 | A1 | * | 9/1999 |
| GB | 2351757 | A | * | 1/2001 |

* cited by examiner

*Primary Examiner*—Robert J Canfield
*Assistant Examiner*—Jessie Fonseca
(74) *Attorney, Agent, or Firm*—Nicholas A. Kees; Godfrey & Kahn, S.C.

(57) ABSTRACT

A cutter clip and methods for installing a gutter cover onto a gutter system are disclosed. The gutter clip includes a mouth portion sized to provide an interference fit between the gutter cover and the mouth portion of the clip which stationarily secures the gutter cover to the gutter clip. The gutter clip is further provided with a mounting portion that fastens to the lip of a gutter. Once assembled, the gutter clip of the present invention provides minimum horizontal and vertical tolerances between the gutter and the gutter cover, such that water may flow freely into the gutter channel, but does not permit debris to be lodged therein.

6 Claims, 5 Drawing Sheets

GUTTER COVER CLIP

BACKGROUND OF THE INVENTION

The present invention relates generally to the field of rain gutters, and more particularly to a clip for mounting a gutter cover on a new rain gutter or an existing rain gutter.

A typical gutter system is mounted just below the edge of a roof of a house or building and is used to collect rainwater and direct the rain water away from the foundation of the house or building. Gutter systems are normally mounted generally horizontally, although tilted lengthwise slightly one way or the other, so that the collected water flows through the gutters until the flowing water reaches down spouts. Water flows into the down spouts, directing the water downward and ultimately in a direction away from the house or building.

As water flows into the gutters, debris such as leaves, sticks and pine needles, for example, is often carried by the water flow from the roof into the gutters. Wind and rain can also cause debris to fall directly into the gutters from, for example, trees that extend above the roof. Such debris can clog the gutters and down spouts and thus prevent the gutter system from performing its intended purpose of directing water away from the house or building, causing rainwater to flow over the sides of the gutters. Ineffective draining of a gutter system can cause deterioration of the gutter. In addition, ineffective drainage of rain water from a gutter system may lead to pooling or concentration of water along the edge of the home or building's foundation. Such pooling can lead to structural damage to the building by undermining the foundation, flooding parts of the building, etc.

To prevent debris and other material or items from clogging gutters and/or down spouts of gutter systems, gutter covers or caps have been developed that at least partially cover the gutters and prevent debris from entering the gutter system, or at least lessen the amount of debris that falls into the gutters to the extent that the aforementioned clogging problems are prevented. The prior known gutter covers have included everything from simple screens placed over the top of the gutter to complex devices designed to slow the water flow to ensure entry into the gutter while expelling debris over the outside edge of the gutter. Examples of devices that are designed for this purpose are disclosed in, for example, U.S. Pat. Nos. 2,672,832, 4,404,775, 4,435,925, 4,796,390, 5,016,404, 5,216,851 and 5,457,916.

Gutter covers typically attach directly to the gutter using fasteners or clips. Conventionally, gutter clips are secured to both the front end of the gutter cover and to the front wall or lip of the gutter. FIGS. 1 and 2 illustrate a prior art gutter clip 10 which secures a gutter cover 12 to a gutter 14. As illustrated, the prior art clip 10 includes a tab 16 for securing the gutter cover to the gutter. However, this configuration requires a slot 18 punched into the gutter cover 12, which can have numerous disadvantages. For example, the punching operation can result in damage to the cover during manufacturing. Further, the gutter cover 12 is also subject to deformation or damage during assembly of the clip with the cover, as the tab must be properly aligned and inserted into the slot, while also maintaining the correct orientation of the clip for assembly with the gutter. Also, the prior art configuration illustrated in FIGS. 1 and 2 results in large horizontal and vertical gaps into which debris may become caught. Finally, the configuration of the slot 18 and the tab 16 tends to become loose as a result of the force of rain and/or wind, which can also damage both the gutter cover 12 and the gutter 14.

The present invention relates to improvements over the structures described above, and to solutions to the problems raised or not solved thereby.

SUMMARY OF THE INVENTION

The present invention provides, in part, a gutter clip for securing a gutter cover to a gutter, the clip including a substantially flat or planar body, a mounting tab extending upwardly and outwardly from the front edge of the planar body which is configured to secure to a lip or an edge of a gutter and a clip portion extending upwardly from an edge of the planar body and substantially perpendicular thereto.

The clip portion includes an arcuate arm configured to fit and contiguously abut the inside surface of the arcuate end of the gutter cover. As will be appreciated by those skilled in the art, the size and shape of the arm can be adjusted to accommodate gutter covers of various size and shape of gutter cover cross sections. The clip portion also includes a tang, which together with the arcuate arm define an opening or mouth for receiving the arcuate end of the gutter cover.

The opening is sized to create an interference fit between the arcuate end of the gutter cover and the gutter clip when the arcuate end is positioned within the opening. As such, the size of the opening is preferably selected based on the thickness of the gutter cover.

The present invention can also include, in part, a method for securing a gutter cover to a gutter, including, providing a gutter clip having a first end configured to securely fasten to one of a lip or a front wall of a gutter, and having a second end configured to retain an arcuate end of a gutter cover, the second end of the gutter clip including an opening providing an interference fit upon engagement of the arcuate end of the gutter cover with the opening of the gutter clip.

The gutter clip of the present invention secures the gutter cover on to the gutter, while providing minimum vertical or horizontal distance between the gutter cover and the gutter. For example, the gutter clip of the present invention, preferably provides, minimum clearance from the frontmost edge of the arcuate end of the gutter cover to the rear edge of the lip of the gutter in the horizontal plane. Preferably, when the clip is securely seated into the inner arc of the cover, it provides no greater than about 0.030 inch gap in this plane, such that looking straight down upon the installed gutter cover, the horizontal gap is preferably no greater than about 0.030 inch.

Further, the gutter clip of the present invention allows for minimum clearance in the vertical plane, as the radius on the arcuate end of the gutter cover travels beyond the tangent of the edge of the gutter lip. During a rain storm, surface tension draws water around the radius of the end of the gutter cover and into the gutter channel, while the momentum of flowing debris forces it outwards off of the front of the gutter.

Accordingly, it can be an objective of the present invention to provide a gutter clip for mounting a gutter cover on a new rain gutter or an existing rain gutter. It can be a related object of the present invention to provide a gutter clip that does not require a gutter cover configured with slots or apertures—such that the gutter cover can be more easily manufactured and installed on a gutter system. Indeed, the present invention provides a gutter clip and method of installation of a gutter cover, in which the gutter clip provides an interference fit to secure the gutter cover in place and is further secured to the gutter itself, without resulting in large gaps between the gutter cover and the gutter but permitting efficient channeling of rain water into the gutter system.

It will be understood by those skilled in the art that one or more aspects of this invention can meet certain objectives, while one or more other aspects can lead to certain other objectives. Each objective may not apply equally, in all instances, to every aspect of the present invention. As such, these and other objects can be viewed in the alternative with respect to any one aspect of the present invention.

Other objects, features, benefits and advantages of the present invention will be apparent in this summary and descriptions of the disclosed embodiments, and will be readily apparent to those skilled in the art. Such objects, features, benefits and advantages will be apparent from the above as taken in conjunction with the accompanying figures and all reasonable inferences to be drawn therefrom.

DETAILED DESCRIPTION OF PREFERRED EMBODIMENTS

Figure 1:
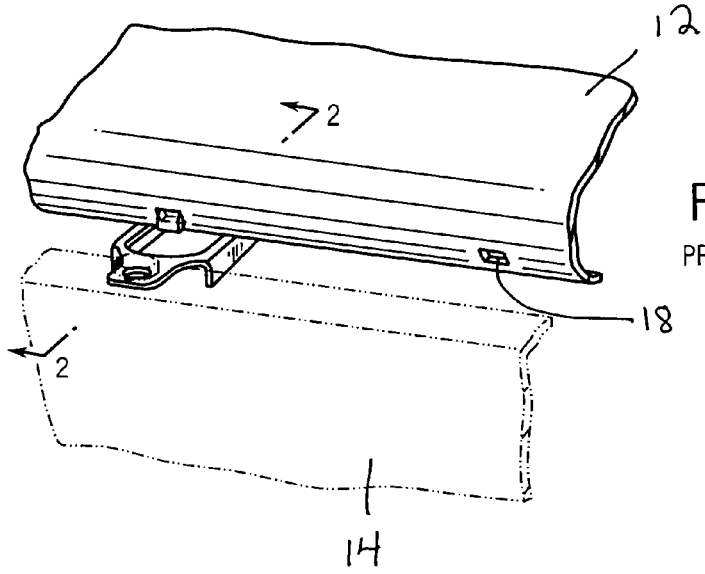
FIG. 1 PRIOR ART
FIG. 1 is a front perspective view of a prior art gutter clip.
Figure 2:
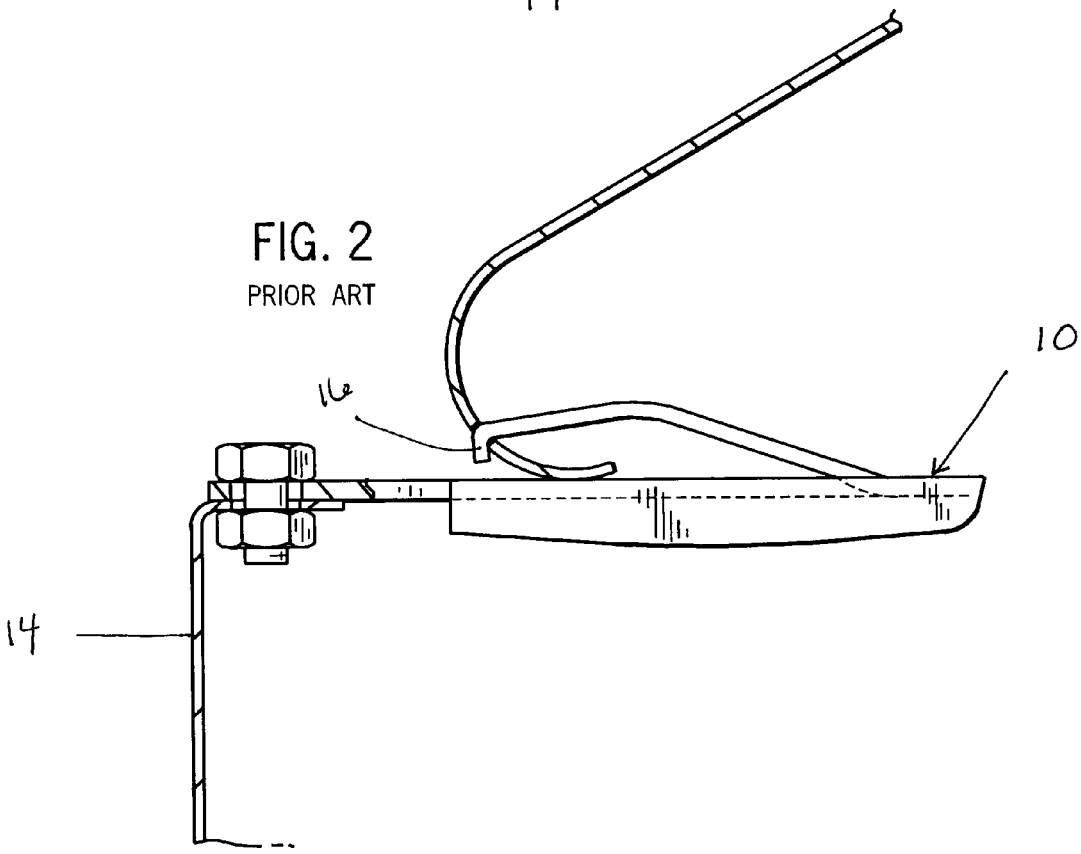
FIG. 2 PRIOR ART
FIG. 2 is a side view of a prior art gutter clip illustrated in FIG. 1.
Figure 3:
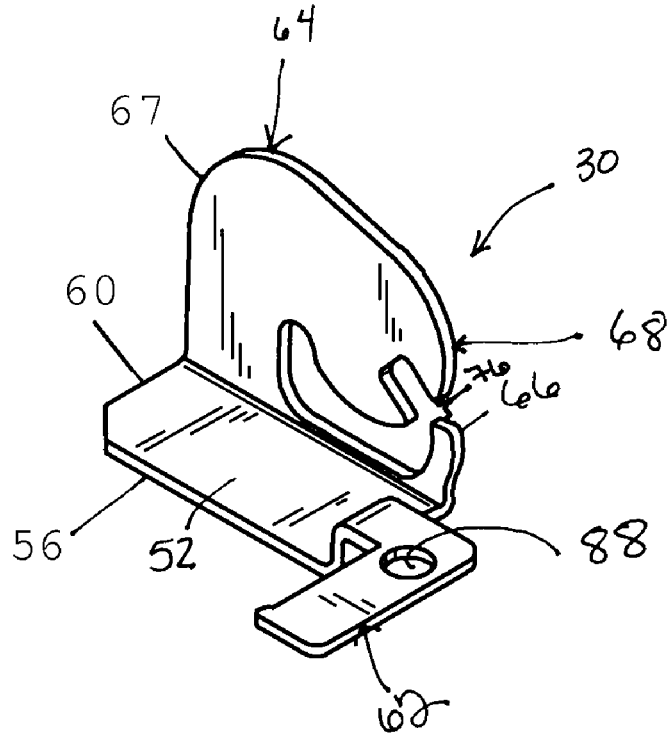
FIG. 3 is front perspective view of a gutter clip of the present invention.
Figure 4:
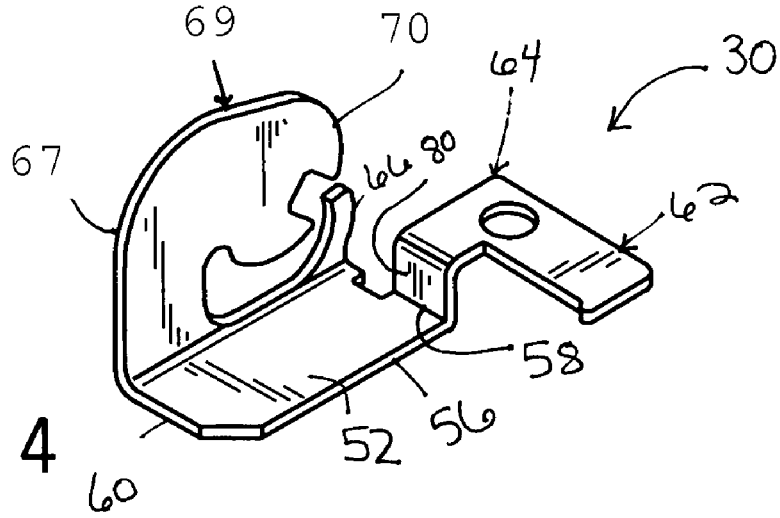
FIG. 4 is rear perspective view of a gutter clip illustrated in FIG. 3.
Figure 5:
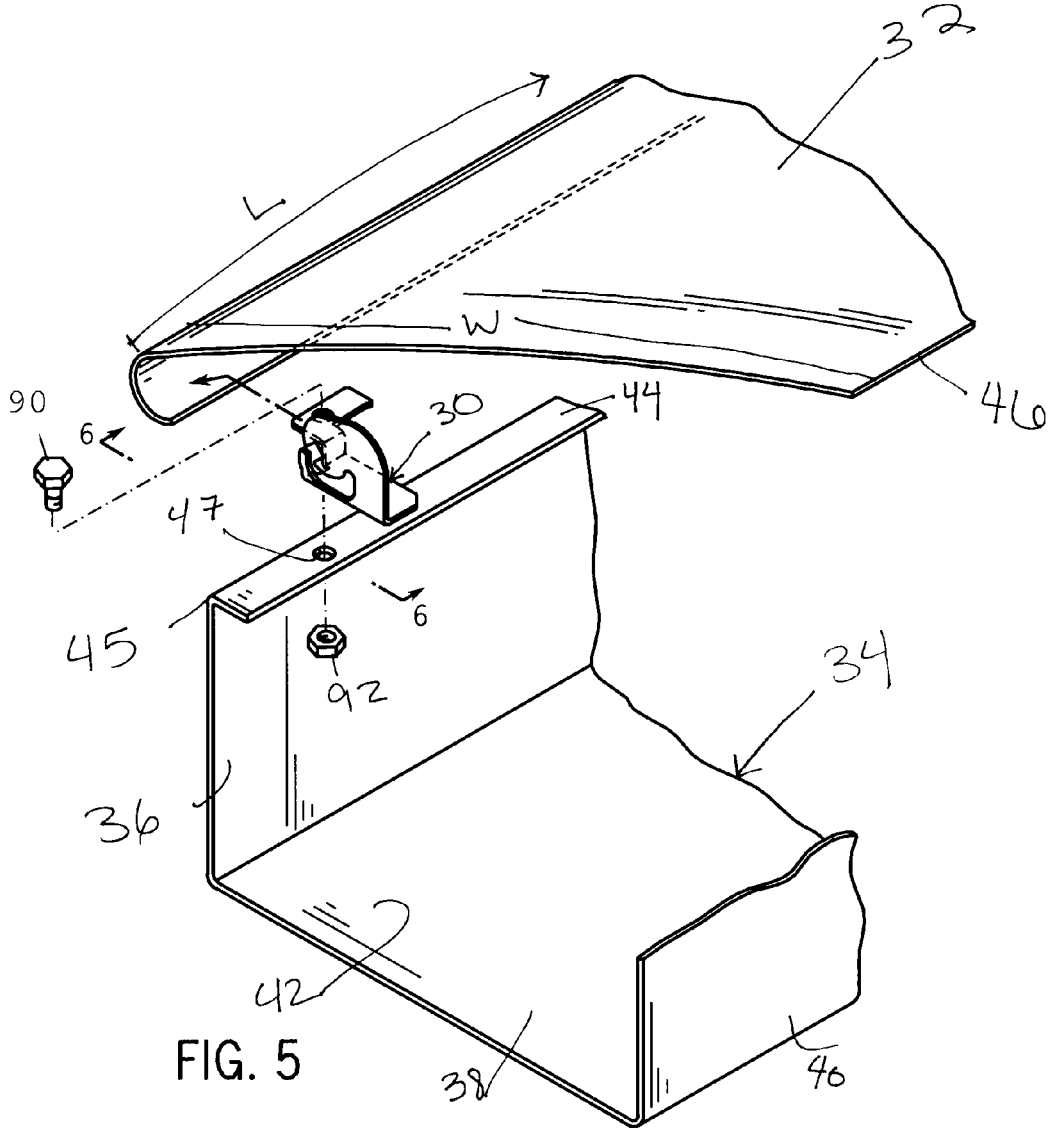
FIG. 5 is an exploded, perspective view of a gutter clip of the present invention before assembly with a gutter and a gutter cover.

Consistent with the teachings of the present invention, FIGS. 3-8 illustrate a preferred embodiment of a gutter clip 30 for coupling a gutter cover 32 to a gutter 34. As illustrated in FIG. 5, the gutter 34 includes a front wall 36, a bottom 38 and a rear wall 40 defining a trough or channel 42 into which rain water is collected and diverted to a downspout or other drainage system. Typically, the gutter 34 includes a flange or lip 44 extending rearwardly from a top edge 45 of the front wall 36 towards the rear wall 40. An aperture 47 is formed or provided transversely through the lip 44 for securing the gutter cover thereto. A number of such apertures 47 would generally be formed or provided along the length of the gutter 34, so that the gutter cover 32 would be fastened at a number of points.

The gutter cover 32 for use with the present invention comprises a first edge 46 running the length of the gutter cover, a substantially planar surface 48, and a second edge 50 opposite first edge 46 and having an arcuate or curved cross section. The gutter cover 32 has a length L and a width W that can be selected based on the particular width and length of the section of gutter 34 onto which the gutter cover 32 is installed, as will be well known to those skilled in the art, and is intended to span the entire width of the gutter channel 42. In typically residential applications, the gutter cover 32 is about four feet in length.

The first edge 46 of the gutter cover 32 is configured to be positioned under the shingle surface of the roof, as will be described in more detail below. The second edge 50 of the gutter cover 32 (also referred to as the nose portion of the gutter cover) has an arcuate or curved shape of substantially constant radius, as best illustrated in FIG. 4. It will be readily recognized that although the present invention is illustrated and described with respect to the gutter cover 32 having an arcuate or curved edge 50, the gutter clip 30 of the present invention is not limited to any particular size or shape of gutter cover 32 cross section, as will be well known to those skilled in the art. Preferably, the gutter cover 32 is a roll formed, aluminum or steel cover panel; however, covers of various materials of construction and methods of manufacture are also contemplated by the present invention.

As best illustrated in FIGS. 3 and 4, the gutter clip 30 includes a substantially flat or planar body 52 having side edges 54 and 56, a front edge 58 that will be oriented towards the front wall 36 of the gutter 34 and a rear edge 60 that will be oriented towards the rear wall 40 of the gutter when the gutter clip 30 and gutter cover 32 are installed thereon. The front edge 58 of the body 52 can include a notch 59 to permit water to flow through the clip 30 and into the gutter 34. A mounting tab 62 extends upwardly and forwardly from the front edge 58 of the body 52 near the side edge 56 thereof. A clip member 64 extends substantially vertically upward from the side edge 54 of the body 52 and is substantially perpendicular to the horizontally disposed body 52 when installed.

Figure 6:
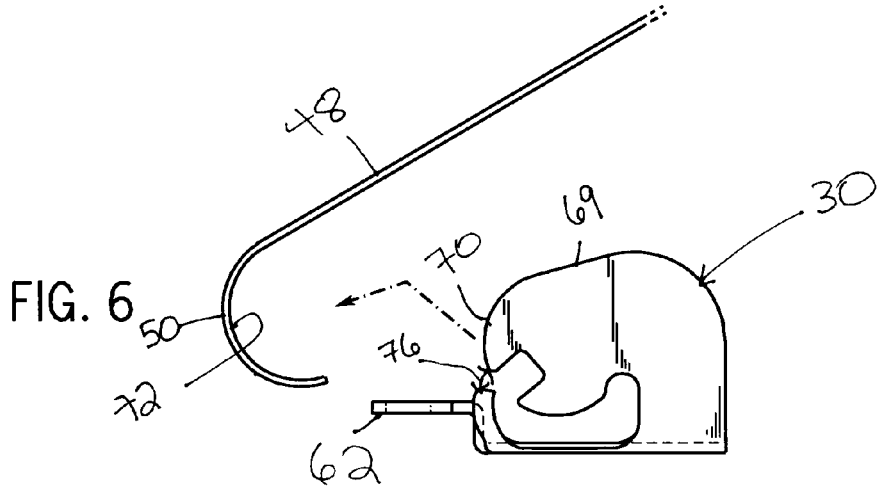
FIG. 6 is a partial cross-sectional view of the gutter clip and gutter cover illustrated in FIG. 5, taken along the line 6-6, showing a detailed depiction of the connection of the cross-sectional configuration of the gutter clip and gutter cover.
Figure 8:
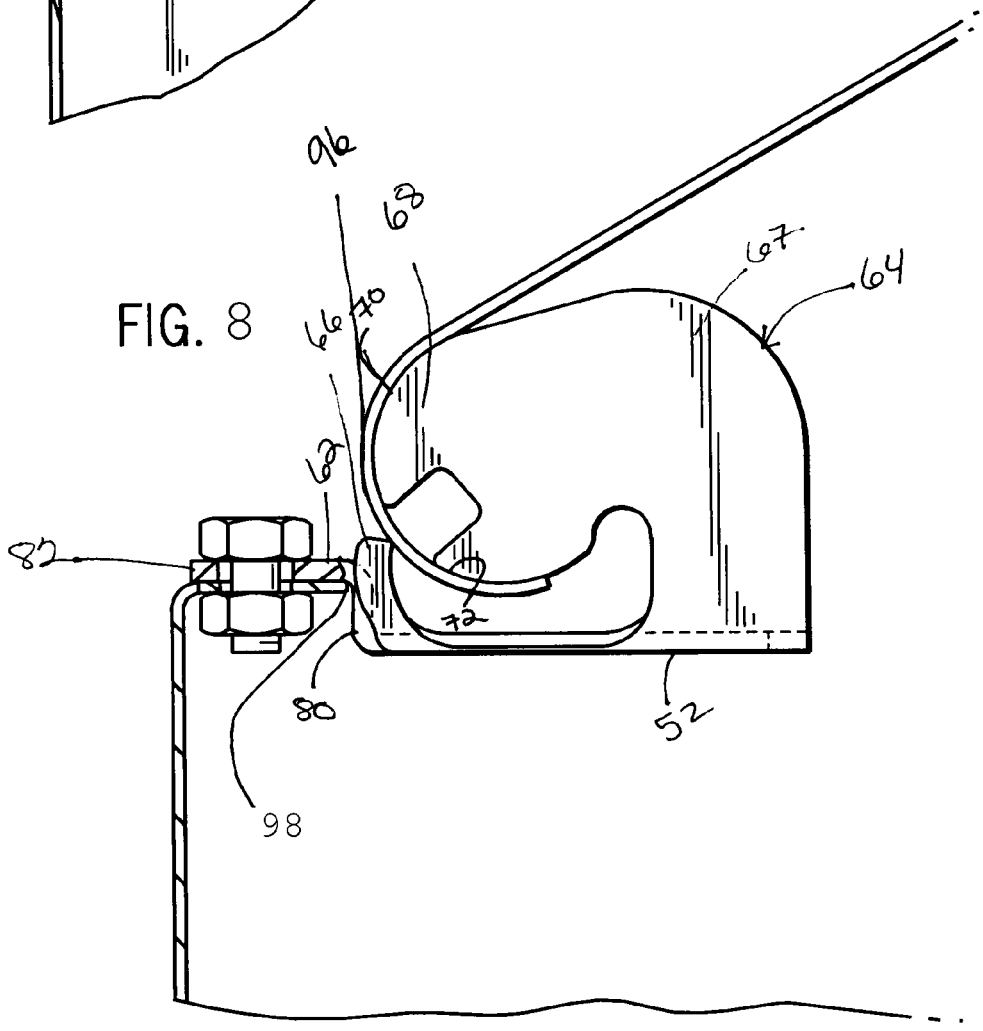
FIG. 8 is a partial cross-sectional view of the gutter clip secured to the gutter cover and fastened to the gutter lip, as illustrated in FIG. 7, taken along the line 8-8.

Turning for the moment to FIGS. 6 and 8, in addition to FIGS. 3 and 4, the clip member 64 of the gutter clip 30 includes a tang 66 that projects upward from substantially the front, side edge of the body 52. Tang 66 is slightly curved in the embodiment shown in the figures. Such a curvature is advantageous in the manufacture of the gutter clip 30, but not required for the gutter clip to function. An arm 67 projects upward from substantially the rear, side edge of the body 52. The arm 67 includes a forwardly projecting portion 68, having a flat portion 69 and an arcuate forward edge 70 of substantially uniform radius. Without limitation to any particular limitation or mode of operation, the flat portion 69 is intended to set a minimum angle for proper engagement of the tang 66 on the gutter cover 32, as will be described in more detail below. As best illustrated in FIGS. 4 and 6, the shape of the forward edge 70 is designed so as to fit and abut the inside surface 72 of the second edge 50 of the gutter cover 32.

As will be appreciated by those skilled in the art, the size and shape of the arm 67, the length of the flat portion 69 and including the shape of forward edge 70, is adjusted so as to accommodate the particular shape of gutter cover 32 and the specific shape of the gutter cover cross sections. The forward portion 68 can include an optional notch 74 to simplify installation of the clip 30 onto the gutter cover 32, as will be explained in more detail below.

As best illustrated in FIG. 6, the tang 66 and the forward portion 68 of the arm 67 form an opening or mouth 76 sized to receive the second edge 50 of the gutter cover 32 to create an interference fit between the second edge 50 and the mouth 76 when the second edge 50 is positioned within the mouth 76. As such, the size of the mouth 76 is preferably selected based on the thickness of the gutter cover 32, as will be well known to those skilled in the art.

Figure 7:
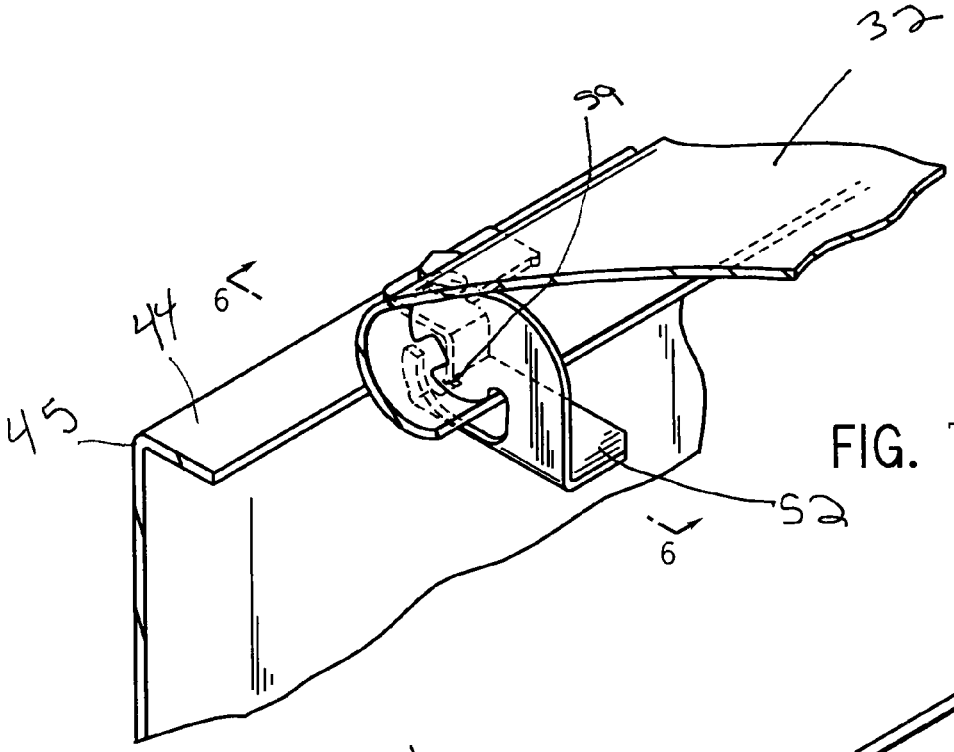
FIG. 7 is a rear, perspective view of the gutter clip illustrated in FIGS. 1 through 6, secured to the gutter cover and fastened to the gutter lip.

The mounting tab 62 includes, in a direction moving away from the body 52, a substantially vertical step 80 and then a flat mounting portion 82 that is substantially perpendicular thereto and substantially parallel to the body. As best illustrated in FIGS. 5, 7 and 8, the mounting portion 82 is preferably configured to overlay a portion of the top surface of the gutter lip 44. The mounting portion 82 may be substantially rectangular in shape and extends a distance 84 rearward of the side edge 58 of the body 52, that is, in the direction toward the body 52. A rearwardly extending protrusion 86 may optionally be provided at the end of the mounting portion 82 opposite the step 80. Without limitation to any particular theory or mode of operation, the protrusion 86 may assist in channeling water into the gutter 34 as it rolls over the clip 30 to prevent spill-over.

A mounting hole 88 is also provided through the mounting portion 82 of the mounting tab 62, for use in fastening the gutter clip 30 to the gutter 34 during installation. It will be appreciated the gutter clip 30 may be configured so that the mounting portion 82 of the mounting tab 62 abuts and is secured to the bottom surface of the gutter lip 44, rather than to the top surface thereof Further, consistent with the broader aspects of the present invention, if the gutter 34 is not provided with a gutter lip 44, the mounting tab 62 can be configured to mount directly to the front wall 36 of the gutter 34, as will be well known to those skilled in the art.

Figure 9:
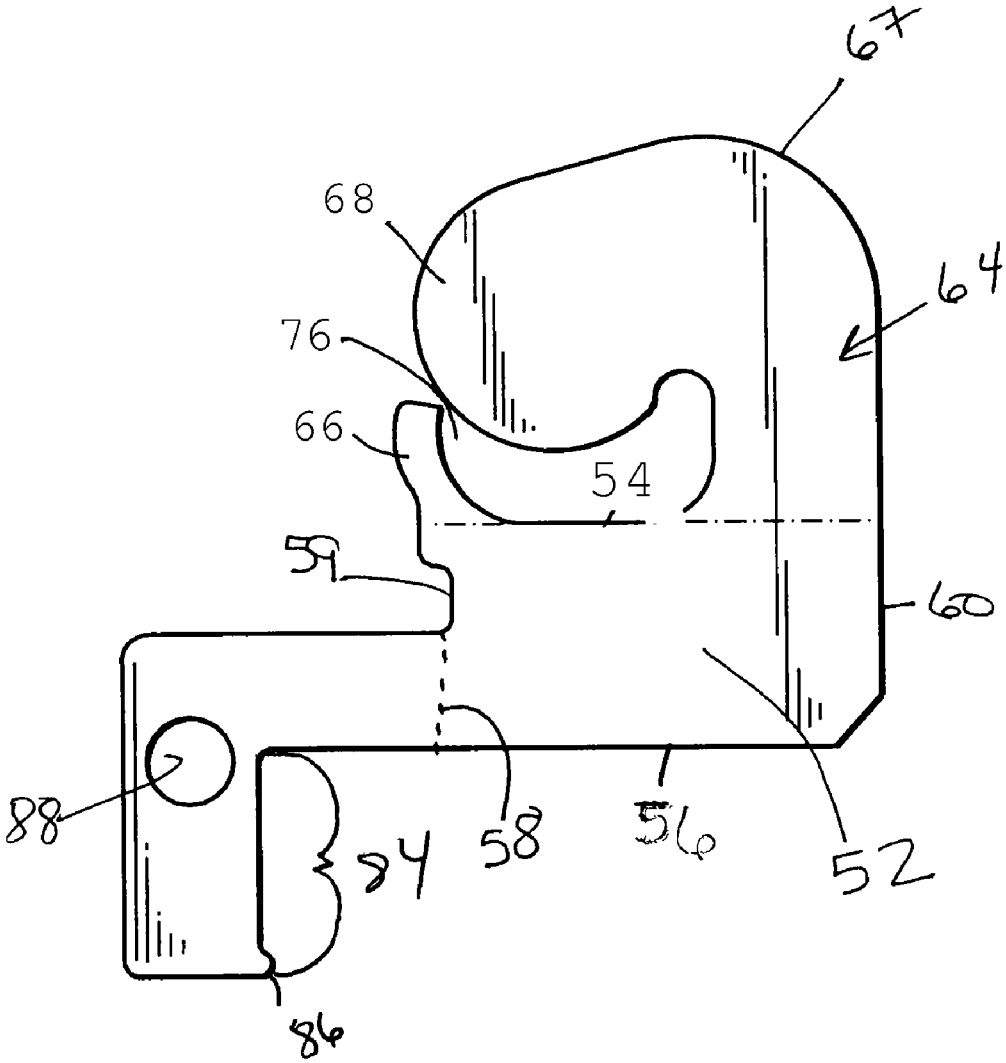
FIG. 9 is a top view of an unformed gutter clip according to the teachings of the present invention.

FIG. 9 illustrates an unformed gutter clip 30 of the present invention, after stamping. The gutter clip 30 is preferably stamped or die-cut from a substantially flat blank material and formed as illustrated in FIGS. 3 through 8. Preferably, the clip 30 is constructed of stainless steel. However, any substantially rigid material known to those skilled in the art, including for example, other metals such as aluminum, or materials such as a thermoplastic or a composite thereof, may be used to construct the clip 30 of the present invention. Consistent with the broader aspects of the present invention, the gutter clip 30 may be manufactured via any process for cutting and forming metal or plastic known to those skilled in the art, and will generally be formed of a material resistant to corrosion from rainwater and solvents occurring therein. Preferably, the gutter clip is a single piece of material; however, the clip may be constructed of more than one piece of material and securely assembled, without departing from the teachings of the present invention.

With reference to FIGS. 3 through 8, a preferred method of installing the gutter cover 32 using the gutter clip 30 of the present invention will now be described. To install the gutter clip 32, the user holds the clip 32 by the body 52 such that the tang 66 and arm 67 are vertically oriented, and the mouth 76 is oriented toward the front wall 36 of the gutter 34. The mouth 76 and tang 66 are then slid over the arcuate, second edge 50 of the gutter cover 32 at an approximately 45 degree angle. Due to the interference fit of the gutter cover into the mouth 76, this step may require a series of rotations to "walk" the tang 66 up the outside surface of the second edge 50 of the gutter cover 32.

When the clip 30 is in position, the forward edge 70 of the forward portion 68 of the arm 67abuts the inside surface 72 of the second edge 50 of the gutter cover 32. The clip 30 is then rotated into place to approximate the correct "angle of mount" to the gutter lip 44. (It will be appreciated that the correct "angle of mount" may depend, in part, on the angle of the gutter lip 44 onto which the clip is to be installed, the pitch of the roof and positioning of the cutter cover over the gutter channel 42, as will be well known to those skilled in the art). Rotation of the clip 30 into position serves to slightly imbed the tang 66 into the outside surface of the gutter cover 32, as the cover 32 is flexed between the tang 66 and the forward portion 68 of the arm 67.

Once a number of the clips 30 are installed along the second edge 50 of the gutter cover 32, the first edge 46 of the cover 32 is slid under the shingle surface and the clips 30 are fastened to the lip 44 of the gutter 34 by inserting a screw 90 through the mounting hole 88. The screw 90 may be threaded into aperture 45 in the gutter lip 44, or alternatively the screw may be secured, and secure the clip 30 to the gutter lip 44, with a nut 92. Other means for securing the gutter clip 30 to the gutter lip 44 can include bolts, staples or any other fastening mechanism known to those skilled in the art.

It will be appreciated from FIGS. 4, 5 and 7, preferably, the location of the vertical clip member 64 with respect to the mounting tab 62 on the body 52 provides an anti-rotation function that substantially prevents rotation of the clip 30 during installation of the clip 30 onto the gutter lip 44. That is, when the screw 90 is turned to connect the mounting tab 62 to the lip 44 and the screw head contacts the lip, a torque will be exerted on the clip 30 tending to rotate it along with the screw head, and location of the clip member will counteract that torque and prevent rotation of the clip, permitting the installer to easily tighten the screw. However, consistent with the broader aspects of the present invention, a mirror image configuration of the gutter clip 30 of the present invention can be provided, where such anti-rotation feature is not required.

As best illustrated in FIG. 8, the gutter clip of the present invention secures the gutter cover 32 on to the gutter 34, while providing minimum vertical or horizontal distance between the gutter cover 32 on to the gutter 34. As illustrated, when installed, the gutter cover 32 has a minimum clearance from the frontmost edge or radius 96 of the arcuate, second edge 50 of the cover 32 to the rear edge 98 of the lip 44 of the gutter 34 in the horizontal plane. Preferably, when the clip 30 is securely seated into the inner arc of the cover 32, it provides, preferably, no greater than about 0.030 inch gap in this plane, such that looking straight down upon the installed gutter cover, the horizontal gap is preferably no greater than about 0.030 inch.

Further, the gutter clip 32 allows for minimum clearance in the vertical plane, as the radius 96 on the second edge 50 of the gutter cover 32 travels beyond the tangent of the edge 98 of the gutter lip 44. Accordingly, during a rain storm, surface tension draws water around the radius of the second end 50 of the gutter cover 32 and into the gutter channel 42, while the momentum of flowing debris forces it outwards off of the front of the gutter.

While several embodiments of the present invention have been shown and described, it is to be understood that many changes and modifications may be made thereunto without departing from the spirit and scope of the invention as defined in the appended claims.

What is claimed is:

1. A gutter clip for securing a gutter cover having a curled edge, to a gutter having a lip with an upper surface, the gutter clip comprising:

a substantially planar body having a front edge, a rear edge and first and second side edges;

a mounting tab extending upwardly and outwardly from the front edge of the planar body, including a step portion and a substantially horizontal portion, the substantially horizontal portion extending beyond the second edge of the planar body; and a clip portion extending upwardly from the first edge of the planar body and substantially perpendicular thereto, the clip portion comprising a tang and an arm with an arcuate edge having a radius configured to contiguously abut the inside surface of the curled edge of the gutter cover when the gutter clip is installed on the gutter cover, the arm and the tang together defining an opening for receiving the curled edge of the gutter cover;

the mounting tab including a mounting hole for securing the gutter clip to the gutter and, once installed, resting on the upper surface of the gutter lip and fastened to the upper surface by one of a screw, a bolt and a staple.

2. The gutter clip of claim 1, wherein the planar body includes a notch formed in the front edge thereof.

3. The gutter clip of claim 1, wherein the substantially horizontal portion includes a protrusion extending from an end thereof.

4. The gutter clip of claim 1, wherein the arcuate edge includes a notch formed in an edge thereof.

5. The gutter clip of claim 1, wherein the planar body, mounting tab and clip portion are integrally formed from one of aluminum and steel.

6. The gutter clip of claim 5, wherein the planar body, mounting tab and clip portion arc constructed of stainless steel.

* * * * *